US012637797B2

(12) United States Patent
Lee et al.

(10) Patent No.: US 12,637,797 B2
(45) Date of Patent: May 26, 2026

(54) WASHING MACHINE SENSING TURBIDITY AND CONTROLLING METHOD THEREOF

(71) Applicant: SAMSUNG ELECTRONICS CO., LTD., Suwon-si (KR)

(72) Inventors: Wanhee Lee, Suwon-si (KR); Kookbae Joo, Suwon-si (KR); Jihyun Woo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 169 days.

(21) Appl. No.: 18/410,606

(22) Filed: Jan. 11, 2024

(65) Prior Publication Data

US 2024/0141575 A1 May 2, 2024

Related U.S. Application Data

(63) Continuation of application No. PCT/KR2023/016220, filed on Oct. 19, 2023.

(30) Foreign Application Priority Data

Oct. 19, 2022 (KR) ..... 10-2022-0135227
Feb. 6, 2023 (KR) ..... 10-2023-0015677

(51) Int. Cl.
*D06F 34/18* (2020.01)
*D06F 33/56* (2020.01)
(Continued)

(52) U.S. Cl.
CPC ..... *D06F 33/57* (2020.02); *D06F 33/56* (2020.02); *D06F 34/06* (2020.02); *D06F 34/18* (2020.02);
(Continued)

(58) Field of Classification Search
None
See application file for complete search history.

(56) References Cited

U.S. PATENT DOCUMENTS 10,494,752 B2 12/2019 Kim
11,492,742 B2 11/2022 Cha et al.
(Continued)

FOREIGN PATENT DOCUMENTS

CN 113774623 A 12/2021
EP 2752515 A1 7/2014
(Continued)

OTHER PUBLICATIONS

International Search Report and Written Opinion of the International Searching Authority dated Feb. 13, 2024, in connection with International Application No. PCT/KR2023/016220, 11 pages.

*Primary Examiner* — Cristi J Tate-Sims

(57) ABSTRACT

A washing machine is disclosed. The washing machine includes: a driving unit configured to rotate a washing tub; a turbidity sensor configured to sense a turbidity of water inside the washing tub; and one or more processors configured to: identify a weight of laundry contained in the washing tub when a user instruction for operating the washing machine is received; identify a saving mode as an operation mode based on a number of minor contaminations identified being equal to or greater than a predetermined number based on a contamination level identification history; identify a normal mode as the operation mode based on the number of minor contaminations identified being smaller than the predetermined number; initiate a washing process based on the weight in the identified operation mode; identify a level of contamination inside the washing tub based on the turbidity of water sensed by the turbidity sensor when a predetermined time elapses after the washing pro-
(Continued)

cess is initiated; and identify whether to terminate the washing process based on the identified level of contamination.

11 Claims, 8 Drawing Sheets

(51) Int. Cl.

| | |
|---|---|
| ***D06F 33/57*** | (2020.01) |
| ***D06F 34/06*** | (2020.01) |
| ***D06F 34/24*** | (2020.01) |
| ***D06F 34/28*** | (2020.01) |
| ***D06F 39/02*** | (2006.01) |
| *D06F 101/02* | (2020.01) |
| *D06F 103/22* | (2020.01) |
| *D06F 103/68* | (2020.01) |
| *D06F 105/48* | (2020.01) |

(52) U.S. Cl.
CPC ..... *D06F 34/24* (2020.02); *D06F 34/28* (2020.02); *D06F 39/02* (2013.01); *D06F 2101/02* (2020.02); *D06F 2103/22* (2020.02); *D06F 2103/68* (2020.02); *D06F 2105/48* (2020.02)

(56) References Cited

U.S. PATENT DOCUMENTS

| | | | | |
|---|---|---|---|---|
| 2017/0342639 | A1 | 11/2017 | Kim | |
| 2018/0002857 | A1* | 1/2018 | Hombroek | D06F 35/005 |
| 2020/0141040 | A1* | 5/2020 | Cha | D06F 34/22 |
| 2021/0095408 | A1 | 4/2021 | Lee | |

FOREIGN PATENT DOCUMENTS

| | | | |
|---|---|---|---|
| JP | 6286658 | B2 | 3/2018 |
| KR | 10-2009-0124563 | A | 12/2009 |
| KR | 10-2011-0133998 | A | 12/2011 |
| KR | 10-2015-0000628 | A | 1/2015 |
| KR | 20160039872 | A | 4/2016 |
| KR | 20170135230 | A | 12/2017 |
| KR | 10-2019-0107619 | A | 9/2019 |
| KR | 20210037305 | A | 4/2021 |
| KR | 102309448 | B1 | 10/2021 |
| KR | 10-2448500 | B1 | 9/2022 |
| KR | 10-2023-0103552 | A | 7/2023 |
| KR | 10-2557925 | B1 | 7/2023 |

* cited by examiner

WASHING MACHINE SENSING TURBIDITY AND CONTROLLING METHOD THEREOF

CROSS-REFERENCE TO RELATED APPLICATIONS

This application is a Bypass Continuation of International Application No. PCT/KR2023/016220, filed Oct. 19, 2023, which claims priority to Korean Patent Application No. 10-2022-0135227, filed Oct. 19, 2022 and Korean Patent Application No. 10-2023-0015677, filed Feb. 6, 2023, the disclosures of which are herein incorporated by reference in their entirety.

BACKGROUND

1. Field

The disclosure relates to a washing machine and a controlling method thereof, and more particularly, to a washing machine sensing a turbidity and performing a washing process based on a level of contamination corresponding to the sensed turbidity and a controlling method thereof.

2. Description of the Related Art

When a user using a washing machine instructs a washing process in a standard mode (or a basic mode), the washing machine may supply detergent corresponding to the standard mode to perform a washing process. Also, the washing machine may include a detergent supply unit (or a detergent supply device), and the detergent supply unit may supply a predetermined amount of detergent.

However, if a predetermined amount of detergent is supplied without considering a level of contamination of laundry, some of the detergent may be wasted when the level of contamination of the laundry is low. In addition, if washing water is maintained at a high temperature and a time for which the washing process needs to be conducted is maintained constant without considering a level of contamination of laundry, energy may be wasted.

There has been a method for supplying an appropriate amount of detergent based on a washing machine use history considering a level of contamination of laundry and automatically adjusting a temperature of washing water and a time for which a washing process needs to be conducted without requiring a user to manually set them.

SUMMARY

According to an embodiment of the disclosure, a washing machine including a washing tub includes: a driving unit configured to rotate the washing tub; a turbidity sensor configured to sense a turbidity of water inside the washing tub; and one or more processors configured to: identify a weight of laundry contained in the washing tub when a user instruction for operating the washing machine is received; identify a saving mode as an operation mode based on a number of minor contaminations identified being equal to or greater than a predetermined number based on a contamination level identification history; identify a normal mode as the operation mode based on the number of minor contaminations identified being smaller than the predetermined number; initiate a washing process based on the weight in the identified operation mode; identify a level of contamination inside the washing tub based on the turbidity of water sensed by the turbidity sensor when a predetermined time elapses after the washing process is initiated; and identify whether to terminate the washing process based on the identified level of contamination.

According to another embodiment of the disclosure, a controlling method of a washing machine includes: identifying a weight of laundry contained in a washing tub when a user instruction for operating the washing machine is received; identifying a saving mode as an operation mode based on the number of minor contaminations identified being equal to or greater than a predetermined number based on a contamination level identification history, and identifying a normal mode as the operation mode based on the number of minor contaminations identified being smaller than the predetermined number; initiating a washing process based on the weight of the laundry in the identified operation mode; identifying a level of contamination inside the washing tub based on a turbidity of water sensed by a turbidity sensor when a predetermined time elapses after the washing process is initiated; and identifying whether to terminate the washing process based on the identified level of contamination.

According to another embodiment of the disclosure, a computer-readable recording medium stores a program for executing a controlling method of a washing machine, the controlling method including: identifying a weight of laundry contained in the washing tub when a user instruction for operating the washing machine is received; identifying a saving mode as an operation mode based on a number of minor contaminations identified being equal to or greater than a predetermined number based on a contamination level identification history, and identifying a normal mode as the operation mode based on the number of minor contaminations identified being smaller than the predetermined number; initiating a washing process based on the weight in the identified operation mode; identifying a level of contamination inside the washing tub based on a turbidity of water sensed by a turbidity sensor when a predetermined time elapses after the washing process is initiated; and identifying whether to terminate the washing process based on the identified level of contamination.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

Definitions for certain words and phrases are provided throughout this patent document, those of ordinary skill in the art should understand that in many, if not most instances, such definitions apply to prior, as well as future uses of such defined words and phrases.

DETAILED DESCRIPTION

Figure 1:
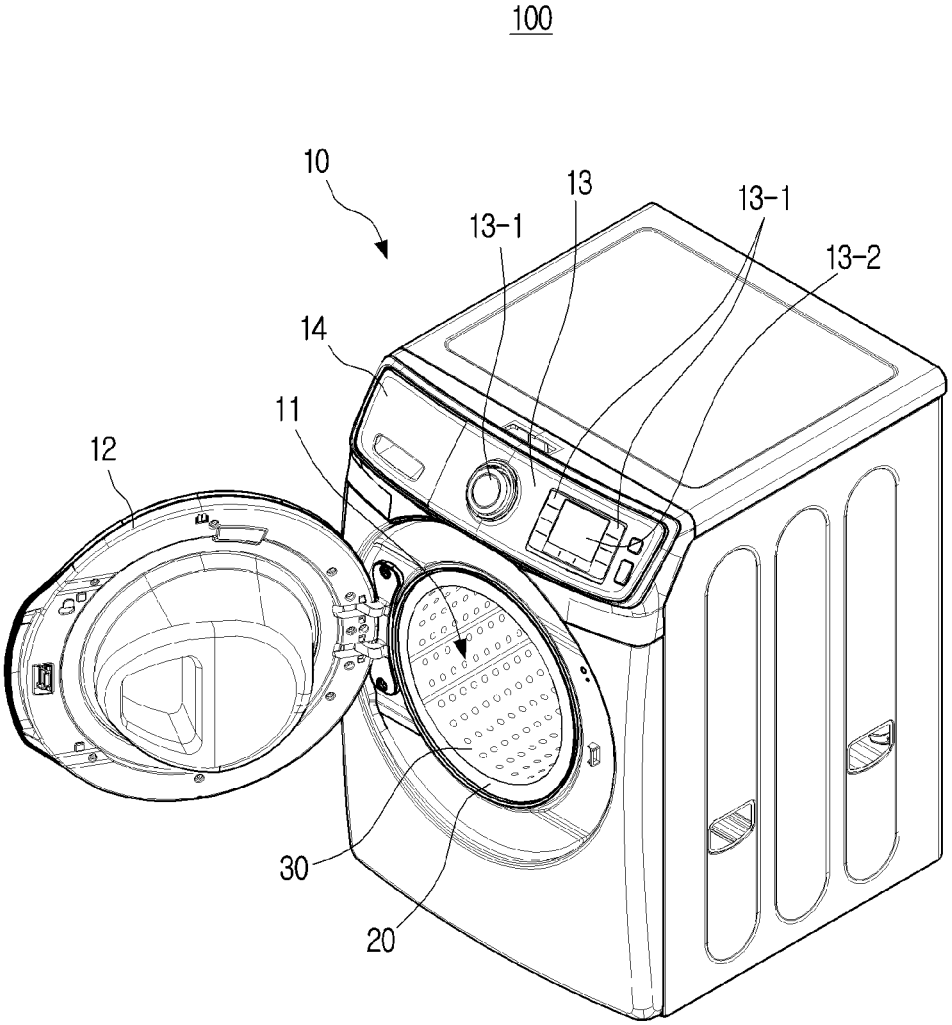
FIG. 1 is a schematic diagram illustrating a washing machine according to one or more embodiments of the disclosure.

FIGS. 1 through 8, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

It should be understood that various embodiments described herein and terms used in describing the embodiments are not intended to limit technical features described herein to the particular embodiments. Rather, the disclosure should be construed to cover various modifications, equivalents, or alternatives of the embodiments described herein.

With regard to the description of drawings, similar or related components may be denoted by similar reference signs.

It is to be understood that a singular form of a noun corresponding to an item may include one item or a plurality of items, unless the context clearly indicates otherwise.

As used herein, each of the phrases "A or B", "at least one of A and B", "at least one of A or B", "A, B, or C", "at least one of A, B, and C", "at least one of A, B, or C", and the like may include any one of, or all possible combinations of the items enumerated together in the phrase.

The term "and/or" includes a combination of a plurality of related recited components or any one of a plurality of related recited components.

The terms "1st" and "2nd", "first" and "second", and the like may be used to simply distinguish a corresponding component from another, and does not limit the components in another aspect (e.g., importance or order).

It is to be understood that if a component (e.g., a first component) is referred to, with or without the term "operatively" or "communicatively", as being "coupled" or "connected" to another element (e.g., a second component), it means that the element may be coupled or connected to the other element directly (e.g., in a wired manner), wirelessly, or via a third component.

The term "include", "have", or the like indicates the presence of features, numbers, steps, operations, components, parts, or combinations thereof stated herein, and does not preclude the presence or addition of one or more other features, numbers, steps, operations, components, parts, or combinations thereof.

When a component is referred to as being "connected to", "combined with", "supported by", or "in contact with" another component, this includes not only a case where the components are connected to, combined with, supported by, or in contact with each other in a direct manner, but also a case where the components are connected to, combined with, supported by, or in contact with each other in an indirect manner via a third component.

When a component is referred to as being positioned "on" another component, this includes not only a case where a component is in contact with another component, but also a case where another component exists between the two components.

A washing machine according to various embodiments may perform washing, rinsing, dewatering, and drying processes. The washing machine is an example of a laundry treatment device, and the laundry treatment device is a concept encompassing a device for washing laundry (objects to be washed and objects to be dried), a device for drying laundry, and a device capable of washing and drying laundry.

The washing machine according to various embodiments may include a top-loading washing machine in which a laundry inlet for loading laundry into the washing machine or taking out the laundry from the washing machine is provided to face upward, or a front-loading washing machine in which a laundry inlet is provided to face forward. The washing machine according to various embodiments may include a washing machine in another loading type as well as the top-loading washing machine and the front-loading washing machine.

The top-loading washing machine is capable of washing laundry using a water flow generated by a rotating body such as a pulsator. The front-loading washing machine is capable of washing laundry by rotating a drum to repeatedly raise and drop laundry. The front-loading washing machine may include a dryer-combined washing machine capable of drying laundry accommodated in a drum. The dryer-combined washing machine may include a hot air supply device for supplying high-temperature air into the drum and a condensing device for removing moisture in the air discharged from the drum. As an example, the dryer-combined washing machine may include a heat pump device. The washing machine according to various embodiments may include a washing machine using a washing method other than the above-described washing method.

The washing machine according to various embodiments may include a housing accommodating various components therein. The housing may be provided in the form of a box in which a laundry inlet is formed on one side thereof.

The washing machine may include a door for opening and closing the laundry inlet. The door may be mounted on the housing to be rotatable by means of a hinge. At least a partial portion of the door may be transparent or translucent so that the inside of the housing can be seen.

The washing machine may include a tub provided inside the housing to store water. The tub may be provided in a substantially cylindrical shape with a tub opening formed on one side thereof, and disposed inside the housing in such a manner that the tub opening corresponds to the laundry inlet.

The tub may be connected to the housing by a damper. The damper may absorb vibration generated while the drum is rotating to dampen vibration to be transmitted to the housing.

The washing machine may include a drum provided to accommodate laundry.

The drum may be disposed inside the tub in such a manner that a drum opening provided on one side thereof corresponds to the laundry inlet and the tub opening. The laundry may be accommodated in the drum by passing through the laundry inlet, the tub opening, and the drum opening sequentially, or may be taken out of the drum by passing through the drum opening, the tub opening, and the laundry inlet sequentially.

The drum may perform an operation corresponding to a washing, rinsing, and/or dewatering process while rotating inside the tub. A plurality of through holes may be formed in a cylindrical wall of the drum to allow water stored in the tub to flow into or out of the drum.

The washing machine may include a driving device configured to rotate the drum. The driving device may include a driving motor and a rotating shaft for transmitting a driving force generated by the driving motor to the drum. The rotating shaft may pass through the tub and be connected to the drum.

The driving device may perform an operation corresponding to a washing, rinsing, dewatering, and/or drying process by rotating the drum forward or backward.

The washing machine may include a water supply device configured to supply water to the tub. The water supply device may include a water supply pipe and a water supply valve provided at the water supply pipe. The water supply pipe may be connected to an external water supply source. The water supply pipe may extend from the external water supply source to a detergent supply device and/or the tub. Water may be supplied to the tub through the detergent supply device. Water may be supplied to the tub without passing through the detergent supply device.

The water supply valve may open or close the water supply pipe in response to an electrical signal from a control unit. The water supply valve may allow or block supply of water from the external water supply source to the tub. The water supply valve may include, for example, a solenoid valve opened and closed in response to an electrical signal.

The washing machine may include a detergent supply device configured to supply detergent to the tub. The detergent supply device may include a manual detergent supply device that requires a user to input detergent to be used every time for washing, or an automatic detergent supply device that stores a large amount of detergent and automatically inputs a predetermined amount of detergent during washing. The detergent supply device may include a detergent box for storing detergent. The detergent supply device may be configured to supply detergent into the tub during a water supply process. Water supplied through the water supply pipe may be mixed with the detergent via the detergent supply device. The water mixed with the detergent may be supplied into the tub. The detergent is used as a term encompassing pre-washing detergent, main-washing detergent, fabric softener, bleach, etc., and the detergent box may be partitioned into an area for storing the pre-washing detergent, an area for storing the main-washing detergent, an area for storing the fabric softener, and an area for storing the bleach.

The washing machine may include a drainage device configured to discharge water accommodated in the tub to the outside. The drainage device may include a drainpipe extending from the bottom of the tub to the outside of the housing, a drain valve provided at the drainpipe to open and close the drain pipe, and a pump provided on the drain pipe. The pump may pump water in the drainpipe out of the housing.

The washing machine may include a control panel disposed on one side surface of the housing. The control panel may provide a user interface for interaction between the user and the washing machine. The user interface may include at least one input interface and at least one output interface.

The at least one input interface may convert sensory information received from the user into an electrical signal.

The at least one input interface may include a power button, an operation button, a course selection dial (or a course selection button), and a washing/rinsing/dewatering setting button. For example, the at least one input interface may include a tact switch, a push switch, a slide switch, a toggle switch, a micro switch, a touch switch, a touch pad, a touch screen, a jog dial, and/or a microphone.

The at least one output interface may visually or audibly convey information related to an operation of the washing machine to the user.

For example, the at least one output interface may transmit information related to a washing course, a time for which the washing machine will be operated, and washing/rinsing/dewatering settings to the user. The information related to the operation of the washing machine may be output through a screen, an indicator, or a sound. For example, the at least one output interface may include a liquid crystal display (LCD) panel, a light emitting diode (LED) panel, and a speaker.

The washing machine may include a communication module for communicating with an external device in a wired and/or wireless manner.

The communication module may include at least one of a short-range communication module and a long-range communication module.

The communication module may transmit data to the external device (e.g., a server, a user device, and/or a home appliance) or receive data from the external device. For example, the communication module may establish communication with the server and/or the user device and/or the home appliance, and transmit/receive various types of data.

To this end, the communication module may support establishing a direct communication channel (e.g., a wired communication channel) or a wireless communication channel between the external devices, and performing communication through the established communication channel. According to one or more embodiments, the communication module is a wireless communication module (e.g., a cellular communication module, a short-range wireless communication module, or a global navigation satellite system (GNSS) communication module) or a wired communication module (e.g., a local area network (LAN) communication module or a power line communication module). Among these communication modules, the corresponding communication module may communicate with the external device through a first network (e.g., a short-range communication network such as Bluetooth, wireless fidelity (WiFi) direct, or infrared data association (IrDA)) or a second network (e.g., a long-range communication network such as a legacy cellular network, a 5G network, a next-generation communication network, the Internet, or a computer network (e.g., LAN or WAN)). These various types of communication modules may be integrated into one component (e.g., a single chip) or implemented as a plurality of separate components (e.g., a plurality of chips).

The short-range wireless communication module may include a Bluetooth communication module, a Bluetooth low energy (BLE) communication module, a near field communication module, a WLAN (Wi-Fi) communication module, a Zigbee communication module, infrared data association (IrDA) communication module, a Wi-Fi direct (WFD) communication module, an ultra-wideband (UWB), an Ant+ communication module, a microwave (uWave) communication module, and the like, but is not limited thereto.

The long-distance communication module may include various types of communication modules that perform long-distance communication, and may include a mobile communication unit. The mobile communication unit transmits and receives a radio signal to and from at least one of a base station, an external terminal, and a server over a mobile communication network.

In one or more embodiments, the communication module may communicate with the external device such as a server, a user device, or another home appliance through a peripheral access point (AP). The access repeater (AP) may connect a local area network (LAN) to which the washing machine or the user device is connected to a wide area network (WAN) to which the server is connected. The washing machine or the user device may be connected to the server through the wide area network (WAN).

The control unit may control various components (e.g., the driving motor and the water supply valve) of the washing machine. The control unit may control various components of the washing machine to perform at least one process including water supply, washing, rinsing, and/or dewatering according to a user input. For example, the control unit may control the driving motor to adjust a rotational speed of the drum or control the water supply valve of the water supply device to supply water to the tub. The control unit may include hardware such as a CPU or a memory and software such as a control program. For example, the control unit may include at least one memory for storing data in the form of an algorithm or a program for controlling operations of components in the washing machine, and at least one processor for performing the above-described operations using the data stored in the at least one memory. The memory and the processor may be implemented as separate chips. The processor may include one or more processor chips or may include one or more processing cores. The memory may include one or more memory chips or include one or more memory blocks. Also, the memory and the processor may be implemented as a single chip.

FIG. 1 is a schematic diagram illustrating a washing machine according to one or more embodiments of the disclosure.

A washing machine 100 according to one or more embodiments may refer to a device for washing laundry using water and detergent and dewatering wet laundry. Also, according to one or more embodiments, the washing machine 100 may dry laundry for which dewatering has been completed.

Referring to FIG. 1, the washing machine 100 may include a main body 10, a tub 20, and a washing tub 30.

The main body 10 forms an exterior of the washing machine 100, and a laundry inlet 11 is provided on a front side of the main body 10 to put laundry into the main body 10 and take out the laundry from the main body 10. A door 12 may be installed in the laundry inlet 11 to be opened and closed.

In addition, an input interface 13 for receiving a user instruction for controlling the washing machine 100 may be provided on the front side of the main body 10. In this case, the input interface 13 may include a plurality of buttons 13-1 for receiving a user instruction for controlling the washing machine 100, and a display 13-2 for displaying information related to the washing machine 100 and washing.

The tub 20 is installed inside the main body 10 of the washing machine 100, and may be formed in a cylindrical shape with an opening facing the laundry inlet 11. The tub 20 may store a predetermined amount of water required for washing.

The washing tub 30 may form a space in which loaded laundry is washed, and may be formed in a cylindrical shape. Meanwhile, the washing tub 30 may also be called a drum, but hereinafter, the term "washing tub 30" will be collectively used for convenience of description. An opening corresponding to the laundry inlet 11 is provided on a front side of the washing tub 30, so that laundry can be put into the washing tub 30 through the opening.

In addition, a plurality of through holes allowing water to pass therethrough may be provided in the washing tub 30. In this case, water stored in the tub 20 may flow into the washing tub 30, and the water inside the washing tub 30 may flow out into the tub 20 through the through hole.

In addition, the washing tub 30 may be rotated by a driving unit provided in the washing machine 100. While the washing tub 30 is rotated by the driving unit, dirt on the laundry put into the washing tub 30 may be removed from the laundry in a process of friction with water stored in the tub 20. Here, the driving unit may be called a driving device, but hereinafter, the term "driving unit" will be collectively used for convenience of description.

Meanwhile, the washing machine 100 may include a water supply device for supplying water to the tub 20 (or the washing tub 30). In this case, the water supply device may include a water supply pipe connected to an external water supply source such as a tap and a water supply valve that opens and closes the water supply pipe.

In addition, the washing machine 100 may include a detergent accommodation unit 14 for supplying detergent, fabric softener, etc. to the tub 20. When the water supply valve is opened and water is supplied to the water supply pipe, the water may be supplied to the detergent accommodation unit 14, and the detergent, the fabric softener, etc. accommodated in the detergent accommodation unit 14 may be mixed with the water. Accordingly, the water mixed with the detergent, the fabric softener, etc. may be supplied to the tub 20. Here, the detergent accommodation unit 14 may be referred to as the above-described detergent supply device, but hereinafter, the term "detergent accommodation unit 14" will be collectively used for convenience of description.

In addition, the washing machine 100 may include a drainage device for draining water stored in the tub 20 to the outside. The drainage device may include a pump and drainpipe. In this case, the pump may discharge the water stored in the tub 20 to the outside of the washing machine 100 through the drainpipe.

The washing machine 100 may perform a laundry course including washing, rinsing, dewatering, etc. to remove dirt from laundry. Meanwhile, the washing course refers to an operation of the washing machine 100 for removing contaminants from the laundry while minimizing damage to the laundry based on characteristics of the material (or fabric or fiber) of the laundry. According to an example, the washing course may include at least one of a washing process, a rinsing process, or a dewatering process.

Determination related to the washing process may include at least one of an amount of washing water to be supplied into the washing tub 30, a temperature of the washing water, an amount of detergent to be supplied into the washing tub 30, a load of the driving unit (e.g., the motor) for rotating the washing tub 30, a rotation speed, and a time for which the washing process needs to be conducted.

Determination related to each of the rinsing process and the dewatering process may also include at least one of an amount of washing water to be supplied into the washing tub 30, a temperature of the washing water, a load of the driving unit (e.g., the motor) for rotating the washing tub 30, a rotation speed, and a time for which each of the rinsing process and the dewatering process needs to be conducted.

The washing machine 100 according to one or more embodiments of the disclosure may identify a level of contamination inside the washing tub 30, and adjust the determination related to at least one of the washing process, the rinsing process, or the dewatering process based on the identified level of contamination.

In addition, the washing machine 100 according to one or more embodiments of the disclosure may include a contamination level identification history, and adjust the determination related to at least one of the washing process, the rinsing process, or the dewatering process based on the contamination level identification history.

Hereinafter, the washing machine 100 that identifies an operation mode based on a contamination level identification history according to various embodiments of the disclosure will be described.

Figure 2:
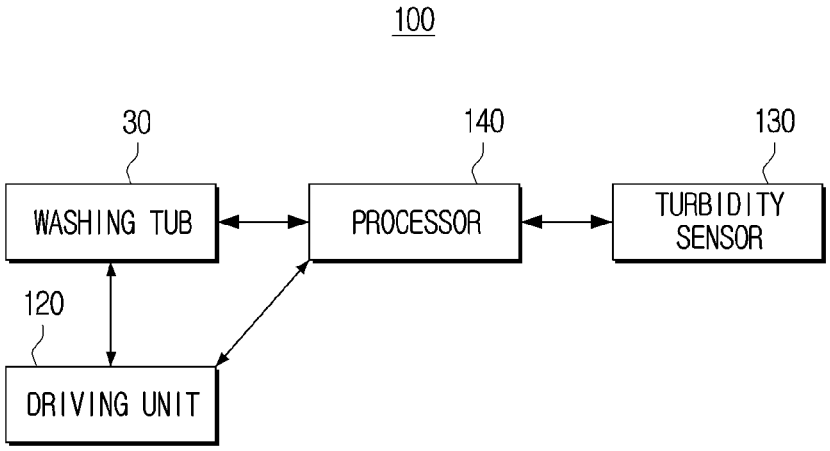
FIG. 2 is a block diagram for explaining a configuration of the washing machine according to one or more embodiments of the disclosure.

FIG. 2 is a block diagram for explaining a configuration of the washing machine according to one or more embodiments of the disclosure.

Referring to FIG. 2, the washing machine 100 according to one or more embodiments of the disclosure includes a washing tub 30, a driving unit 120, a turbidity sensor 130, and a processor 140. In addition to the components described above, the washing machine 100 may include various components. The redundant descriptions of the main body 10 and the tub 20, which have been described with reference to FIG. 1, will be omitted.

The driving unit 120 includes a driving motor, and rotates the washing tub 30 in which laundry is accommodated by using the driving motor. The driving unit 120 rotates the driving motor by changing a current applied to the driving motor, and a driving force generated according to the rotation of the driving motor may be transmitted to a pulsator only or transmitted to the washing tub 30 and the pulsator simultaneously. In addition, when a control signal generated by the processor 140 is received, the driving unit 120 may drive the detergent supply unit to supply detergent contained in the detergent supply unit to the washing tub 30. In addition, when a control signal generated by the processor 140 is received, the driving unit 120 may drive a water supply unit to supply washing water into the washing tub 30, or drive a drainage unit to discharge washing water accommodated in the washing tub 30 to the outside of the washing machine 100. Meanwhile, the driving motor provided in the driving unit 120 may be implemented, for example, using an alternating current (AC) motor or a brush-less direct current (BLDC) motor.

The turbidity sensor 130 according to one or more embodiments of the disclosure may sense a turbidity of water (i.e., washing water) in the tub 20. Here, the water in the tub 20 may refer to a mixture. For example, the turbidity sensor 130 may sense a turbidity of a mixture of dissolved detergent, contaminants discharged from laundry, and water supplied through the water supply pipe.

Hereinafter, the turbidity of the mixture will be referred to as a turbidity of washing water (or water).

The turbidity sensor 130 according to an example of the disclosure may be implemented as an optical-type sensor or a current detection-type sensor.

Here, the turbidity sensor 130 implemented in the optical type may include a light emitting unit that emits light to water and a light receiving unit that receives light passing through the water. The turbidity sensor 130 implemented in the optical type may sense a turbidity of the water based on a ratio (or an amount of light) of the light received by the light receiving unit to the light emitted by the light emitting unit.

Here, the turbidity sensor 130 implemented in the current detection type may include a power supply unit that supplies a current to water and an ammeter that measures a current passing through the water. The turbidity sensor 130 implemented in the current detection type may sense a turbidity of the water based on a ratio of the current measured by an ammeter to the current supplied by the power supply unit or the like.

The turbidity sensor 130 according to an example of the disclosure may detect a turbidity of washing water used in a washing process or a rinsing process, and one or more processors 140 may identify a level of contamination inside the tub 20 (or the washing tub 30) based on the detected turbidity.

As will be described below, the one or more processors 140 may adjust the determination related to the washing process or the decision related to the rinsing process based on the identified level of contamination.

For example, the one or more processors 140 may classify the identified level of contamination as one of minor or light contamination, normal contamination, and heavy contamination, and may adjust at least one of an amount of washing water to be supplied into the washing tub 30 during the washing process, a temperature of the washing water, an amount of detergent to be supplied into the washing tub 30, a load of the driving unit (e.g., the motor) for rotating the washing tub 30, a rotation speed, and a time for which the washing process needs to be conducted.

In addition, the one or more processors 140 may adjust at least one of an amount of washing water to be supplied into the washing tub 30 during the rinsing process, a temperature of the washing water, a load of the driving unit (e.g., the motor) for rotating the washing tub 30, a rotation speed, and a time for which the rinsing process needs to be conducted.

The one or more processors 140 according to an example controls overall operations of the washing machine 100.

According to one or more embodiments of the disclosure, the one or more processors 140 may be implemented as a digital signal processor (DSP) that processes a digital signal, a microprocessor, or a timing controller (TCON). However, the one or more processors 140 are not limited thereto, and may include one or more of a central processing unit (CPU), a micro controller unit (MCU), a micro processing unit (MPU), a controller, an application processor (AP), a communication processor (CP), an ARM processor, and an artificial intelligence (AI) processor, or may be defined by these terms. In addition, the one or more processors 140 may be implemented as a system on chip (SoC) having a processing algorithm stored therein or a large scale integration (LSI), or may be implemented in the form of a field programmable gate array (FPGA). The one or more processors 140 may perform various functions by executing computer executable instructions stored in the memory.

The one or more processors 140 may include one or more of a central processing unit (CPU), a graphics processing unit (GPU), an accelerated processing unit (APU), a many integrated core (MIC), a digital signal processor (DSP), a neural processing unit (NPU), a hardware accelerator, or a machine learning accelerator. The one or more processors 140 may control one or any combination of the other components of the electronic device, and may perform communication-related operations or data processing. The one or more processors 140 may execute one or more programs or instructions stored in the memory. For example, the one or more processors 140 may perform a method according to one or more embodiments of the disclosure by executing one or more instructions stored in the memory.

In a case where the method according to one or more embodiments of the disclosure includes a plurality of operations, the plurality of operations may be performed by one processor or by a plurality of processors. For example, in a case where a first operation, a second operation, and a third operation are performed by the method according to one or more embodiments, all of the first operation, the second operation, and the third operation may be performed by a first processor, or the first operation and the second operation may be performed by the first processor (e.g., a general-purpose processor) and the third operation may be performed by a second processor (e.g., an artificial intelligence-dedicated processor).

The one or more processors 140 may be implemented as a single-core processor including one core, or may be implemented as one or more multi-core processors including a plurality of cores (e.g., homogeneous multiple cores or heterogeneous multiple cores). In a case where the one or more processors 140 are implemented as multi-core processors, each of the plurality of cores included in the multi-core processors may include a processor internal memory such as a cache memory or an on-chip memory, and a common cache shared by the plurality of cores may be included in multi core processors. In addition, each of the plurality of cores (or some of the plurality of cores) included in the multi-core processors may independently read and execute program instructions for implementing the method according to one or more embodiments of the disclosure, or all (or some) of the plurality of cores may be linked to each other to read and execute program instructions for implementing the method according to one or more embodiments of the disclosure.

In a case where the method according to one or more embodiments of the disclosure includes a plurality of operations, the plurality of operations may be performed by one of the plurality of cores included in the multi-core processors, or may be performed by the plurality of cores. For example, in a case where a first operation, a second operation, and a third operation are performed by the method according to one or more embodiments, all of the first operation, the second operation, and the third operation may be performed by a first core included in the multi-core processors, or the first operation and the second operation may be performed by the first core included in the multi-core processors, and the third operation may be performed by a second core included in the multi-core processors.

In embodiments of the disclosure, the processor may refer to a system on a chip (SoC) in which one or more processors and other electronic components are integrated, a single-core processor, multi-core processors, or a core included in the single-core processor or the multi-core processors. Here, the core may be implemented as a CPU, a GPU, an APU, an MIC, a DSP, an NPU, a hardware accelerator, a machine learning accelerator, or the like, but the embodiments of the disclosure are not limited thereto.

In particular, the one or more processors 140 according to an example of the disclosure may identify a weight of laundry contained in the washing tub 30 when a user instruction for operating the washing machine 100 is received.

Also, the one or more processors 140 may identify one of a plurality of operation modes of the washing machine 100 based on the contamination level identification history. For example, the one or more processors 140 may identify a saving mode as an operation mode among the plurality of operation modes, based on the number of times minor contamination is identified being equal to or greater than a predetermined number based on the contamination level identification history.

For example, based on the number of times minor contamination is identified being equal to or greater than the predetermined number according to the contamination level identification history, the washing machine 100 according to an example may perform a washing course in the saving mode, because the level of contamination of laundry (e.g., a degree of contamination of laundry or how many contaminants there are on laundry) for which the washing machine 100 performs a washing process is generally low.

Here, the plurality of operation modes may include a saving mode and a normal mode. However, this is an example, and the plurality of operation modes are not limited thereto. For example, the plurality of operation modes may include a saving mode, a normal mode, and a high output mode.

The saving mode may be called an eco mode, a power saving mode, a low power mode, or the like, but hereinafter, the term "saving mode" will be collectively used for convenience of description.

The normal mode may be called a basic mode, a standard mode, or the like, but hereinafter, the term "normal mode" will be collectively used for convenience of description.

The high power mode may be called a boost mode, a maximum power mode, or the like, but hereinafter, the term "high power mode" will be collectively used for convenience of description.

Subsequently, the one or more processors 140 may initiate a washing process based on the weight of laundry in the identified operation mode.

For example, even though the weight of laundry is the same, when the operation mode of the washing machine 100 is the power saving mode, the one or more processors 140 may relatively reduce at least one of an amount of washing water to be supplied into the washing tub 30, a temperature of the washing water, an amount of detergent to be supplied into the washing tub 30, a load of the driving unit for rotating the washing tub 30, a rotation speed, or a time for which the washing process needs to be conducted, as compared to that in the normal mode.

Figure 3:
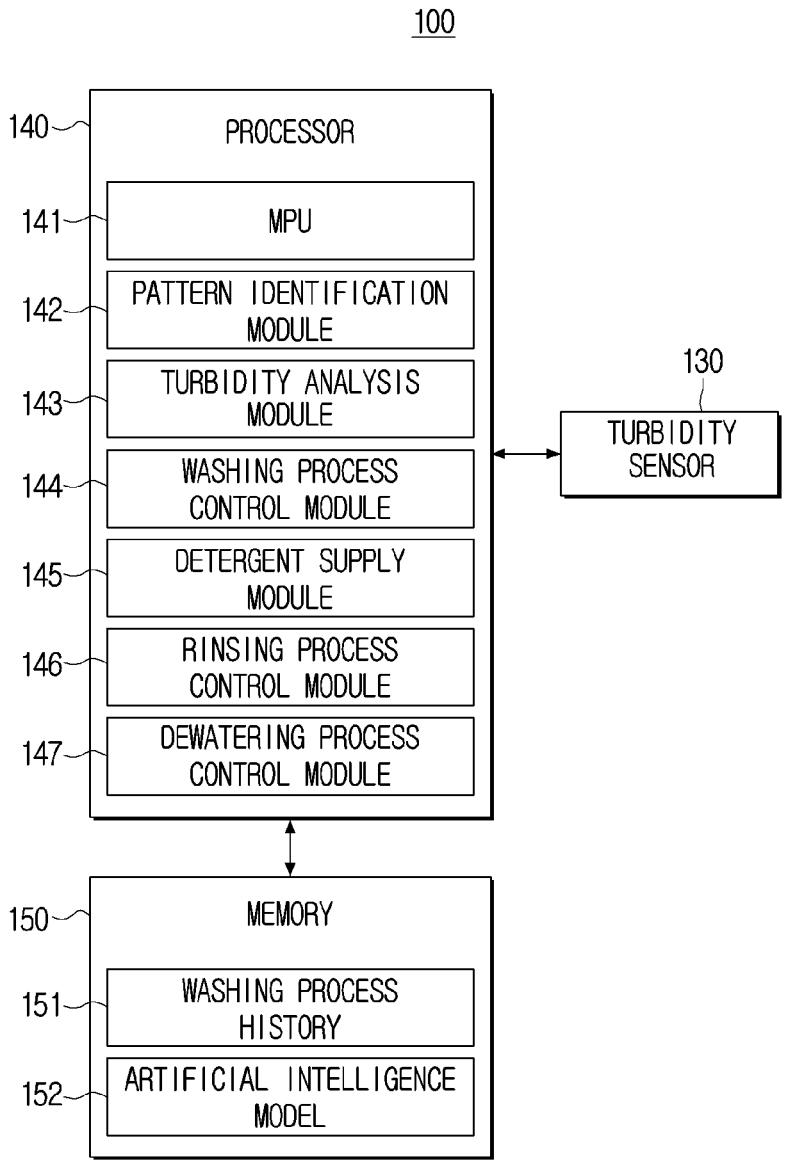
FIG. 3 is a detailed block diagram for explaining the configuration of the washing machine according to one or more embodiments of the disclosure.

FIG. 3 is a detailed block diagram for explaining the configuration of the washing machine according to one or more embodiments of the disclosure.

FIG. 3 is a diagram for explaining a process in which the module included in the one or more processors 140 uses a turbidity sensor 130 and a memory 150.

Here, the turbidity sensor 130 may detect a turbidity of water after a washing process is initiated according to the control of the one or more processors 140.

According to an example, the processor 140 may include at least one of a microprocessor unit (MPU) 141, a pattern identification module 142, a turbidity analysis module 143, a washing process control module 144, a detergent supply module 145, a rinsing process control module 146, a dewatering process control module 147. Here, the MPU 141 may perform a calculation (or arithmetic) operation.

The pattern identification module 142 may be a module that identifies a user's washing machine use pattern. Specifically, the pattern identification module 142 may identify whether washing processes in which turbidities are smaller than a threshold value have been performed at a predetermined ratio or more with respect to all of the washing processes of the washing machine 100.

The turbidity analysis module 143 may be a module that identifies a level of contamination based on the turbidity of water.

The washing process control module 144 may be a module that controls an operation related to a washing process. The detergent supply module 145 may perform the washing process based on the determined amount of detergent and the determined washing time. The detergent supply module 145 may supply detergent to the inside of the drum before or during the washing process.

The rinsing process control module 146 may be a module that controls an operation related to a rinsing process. The rinsing process control module 146 may perform the rinsing process based on the determined volume of water, the determined rinsing time, and the determined number of times of rinsing.

The dewatering process control module 147 may be a module that controls an operation related to a dewatering process. The dewatering process control module 147 may perform the dewatering process based on the determined rotation speed and the determined dewatering time.

According to an example, the memory 150 may include at least one of a washing process history 151 and an artificial intelligence model 152. Here, the washing process history 151 may include a contamination level identification history.

For example, the one or more processors 140 may identify a level of contamination inside the washing tub 30 based on the turbidity of the laundry detected by the turbidity sensor after contaminants are discharged from the laundry, that is, when a predetermined time elapses after the washing process is initiated.

For example, the one or more processors 140 may classify the identified level of contamination as one of minor contamination, normal contamination, and heavy contamination.

Subsequently, the one or more processors 140 may update the contamination level identification history based on the identified level of contamination.

Based on the number of times minor contamination is identified being equal to or greater than a predetermined number based on the contamination level identification history, the pattern identification module 142 of the one or more processors 140 according to an example of the disclosure may identify the saving mode as an operation mode of the washing machine 100.

Subsequently, the one or more processors 140 according to one or more embodiments of the disclosure may initiate a washing process in a washing course based on the weight of the laundry in the saving mode.

As another example, based on the number of times minor contamination is identified being smaller than the predetermined number based on the contamination level identification history, the pattern identification module 142 of the one or more processors 140 may identify the normal mode as an operation mode of the washing machine 100. Subsequently, the one or more processors 140 according to an example of the disclosure may initiate a washing process in a washing course based on the weight of the laundry in the normal mode.

First, an embodiment in which the one or more processors 140 acquire and store a contamination level identification history according to an example will be described with reference to FIGS. 4 and 5.

Figure 4:
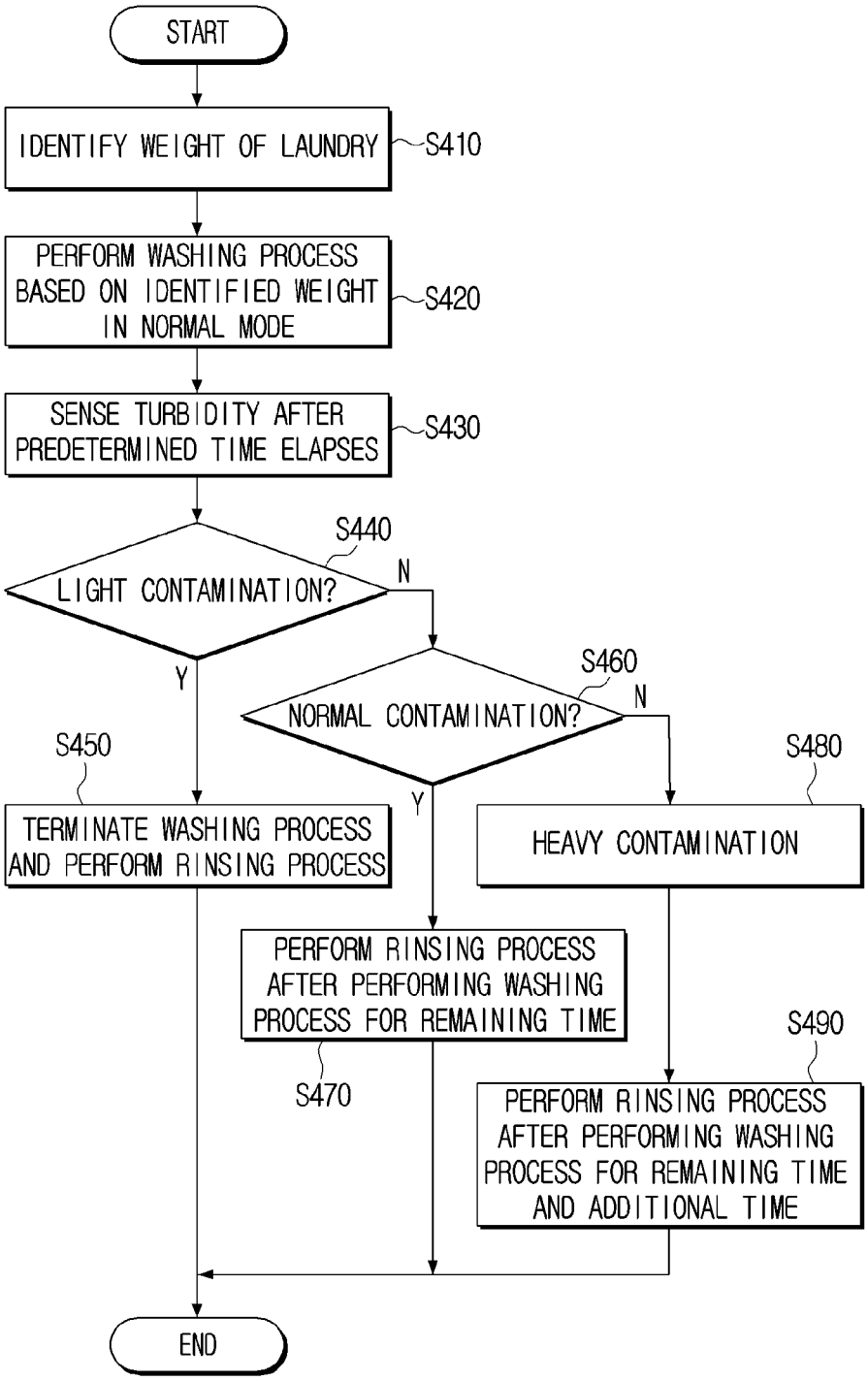
FIG. 4 is a flowchart for explaining the washing machine that senses a turbidity after initiating a washing process according to one or more embodiments of the disclosure.

FIG. 4 is a flowchart for explaining the washing machine that senses a turbidity after initiating a washing process according to one or more embodiments of the disclosure.

Based on no contamination level identification history (based on no contamination level identification history being stored in the memory 150) or based on the number of multiple levels of contamination included in the contamination level identification history being smaller than a threshold number, the one or more processors 140 according to one or more embodiments of the disclosure may identify the normal mode as an operation mode.

Referring to FIG. 4, the one or more processors 140 may identify a weight of laundry contained in the washing tub 30 when a user instruction for operating the washing machine 100 is received (S410).

Subsequently, the one or more processors 140 may perform a washing process in a washing course based on the identified weight in the normal mode (S420).

The one or more processors 140 according to one or more embodiments of the disclosure may identify a level of contamination inside the washing tub 30 based on a turbidity of water sensed by the turbidity sensor 130 when a predetermined time elapses after the washing process is initiated (S430).

Based on the identified level of contamination corresponding to minor contamination (S440: Y), the one or more processors 140 may terminate the washing process and initiate a rinsing process (S450). For example, based on the turbidity sensed by the turbidity sensor 130 when the predetermined time elapses after the washing process is initiated being smaller than the threshold value, the one or more processors 140 may identify the level of contamination inside the washing tub 30 to be minor contamination, and may terminate the washing process because the washing process for a residual time is unnecessary. Here, the residual time may refer to a remaining time obtained by subtracting the predetermined time from the time for which the washing process needs to be performed in the normal mode.

As another example, based on the identified level of contamination corresponding to normal contamination (S440: N and S460: Y), the one or more processors 140 may initiate a rinsing process after performing the washing process for the residual time (S470).

As another example, based on the identified level of contamination corresponding to heavy contamination (S460: N and S480), the one or more processors 140 may initiate a rinsing process after performing the washing process for the residual time and an extra time (S490). For example, based on the identified level of contamination corresponding to heavy contamination, the one or more processors 140 may adjust the determination related to the washing process.

As described above, the determination related to the washing process may include at least one of an amount of washing water to be supplied into the washing tub 30, a temperature of the washing water, an amount of detergent to be supplied into the washing tub 30, a load of the driving unit (e.g., the motor) for rotating the washing tub 30, a rotation speed, or a time for which the washing process needs to be conducted, and the one or more processors 140 may perform the washing process for an extra time in addition to the time for which the washing process needs to be conducted in the normal mode by adjusting the time for which the washing process needs to be conducted.

Meanwhile, the one or more processors 140 according to an example may store the level of contamination identified in step S430 in the memory 150. For example, the one or more processors 140 may generate a contamination level identification history and update the contamination level identification history based on the level of contamination identified in step S430.

Figure 5:
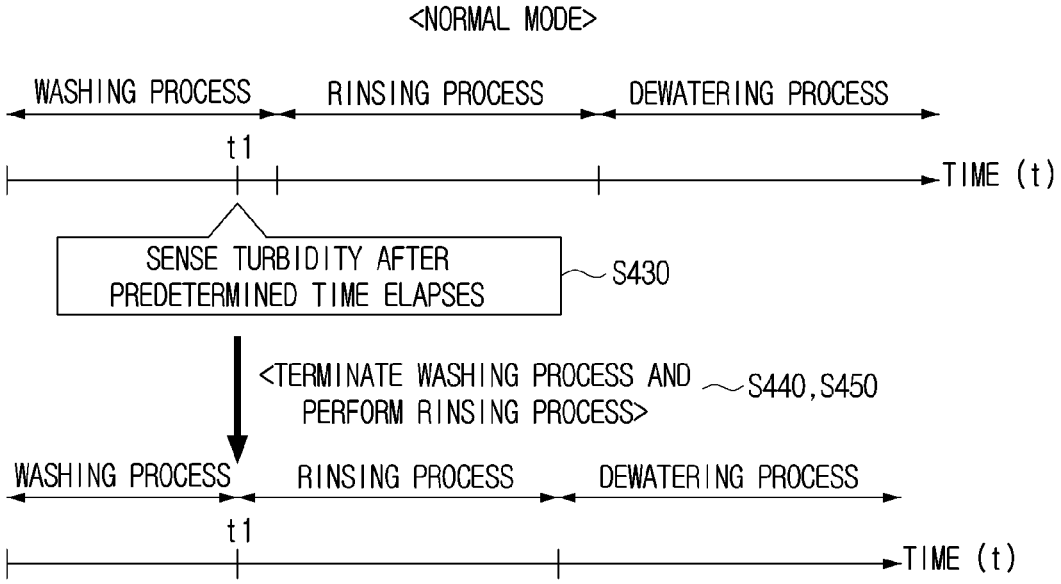
FIG. 5 is a flowchart for explaining the washing machine that identifies whether to terminate the washing process by identifying a level of contamination inside a washing tub according to one or more embodiments of the disclosure.

FIG. 5 is a flowchart for explaining the washing machine that identifies whether to terminate the washing process by identifying a level of contamination inside the washing tub according to one or more embodiments of the disclosure.

Referring to FIG. 5, based on the level of contamination identified in step S430 corresponding to minor contamination (S440: Y), the one or more processors 140 may terminate the washing process and perform a rinsing process.

Specifically, when a predetermined time t1 elapses after a washing process is initiated according to a user instruction, the one or more processors 140 may identify a level of contamination inside the washing tub 30 based on a turbidity of water sensed by the turbidity sensor 130. According to an example, based on the identified level of contamination corresponding to minor contamination, the washing process may be terminated because the washing process for a remaining time obtained by subtracting the predetermined time from the time for which the washing process needs to be performed in the normal mode (that is, a residual time) is unnecessary.

Meanwhile, according to an example, based on the number of times minor contamination is identified being equal to or greater than a predetermined number based on the contamination level identification history, the one or more processors 140 may identify the saving mode, rather than the normal mode, as an operation mode of the washing machine 100, and perform a washing course (i.e., a washing process, a rinsing process, and a dewatering process corresponding to the saving mode).

For example, in the saving mode, at least one of an amount of detergent to be supplied to the washing tub 30, a time for which the washing process needs to be conducted, a temperature of water to be supplied to the washing tub 30, or a rotation speed of the driving unit 120 decreases as compared to that in the normal mode. Therefore, when the washing machine 100 operates in the saving mode, it is possible to reduce consumption of detergent and consumption of power as compared to those when the washing machine 100 operates in the normal mode.

According to an example, based on a user's use pattern (that is, based on levels of contamination of laundry washed by the washing machine 100 generally corresponding to minor contamination), the one or more processors 140 may set the operation mode of the washing machine 100 to the saving mode without any additional manipulation or setting. This will be described in detail with reference to FIG. 6.

Figure 6:
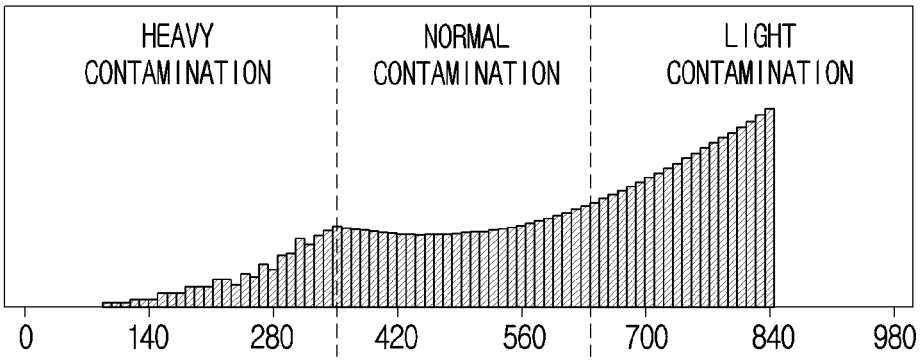
FIG. 6 is a diagram for explaining a contamination level identification history according to one or more embodiments of the disclosure.

FIG. 6 is a diagram for explaining a contamination level identification history according to one or more embodiments of the disclosure.

Referring to FIG. 6, based on the number of times minor contamination is identified among a plurality of levels of contamination included in the contamination level identification history being equal to or greater than a predetermined number, the one or more processors 140 may identify the saving mode as an operation mode of the washing machine 100.

For example, based on a ratio of minor contamination among the plurality of levels of contamination being 70% or more, the one or more processors 140 may identify the saving mode as an operation mode of the washing machine 100. Here, the specific numerical value is arbitrarily presented for convenience of description, and the numerical value is not limited thereto.

Based on a pattern in which laundry with minor contamination is mostly washed being identified using the contamination level identification history, the one or more processors 140 according to one or more embodiments of the disclosure may control the washing machine 100 to operate in the saving mode, for example, by lowering a temperature of washing water, reducing an amount of detergent to be supplied to the washing tub 30, or reducing a time for which the washing process needs to be conducted. In a case where the one or more processors 140 operate the washing machine 100 in the normal mode without considering the contamination level identification history, there is a problem that energy is wasted because the temperature of the washing water is unnecessarily high even when the washing machine is generally used in such a pattern that laundry with minor contamination is washed, the amount of detergent supplied to the washing tub 30 is unnecessarily large, and the time for which the washing process is conducted is unnecessarily long.

Based on identification that the washing machine is generally used in such a pattern that laundry with minor contamination is washed, the one or more processors 140 according to an example of the disclosure may operate the washing machine 100 in the saving mode, and identify a level of contamination inside the washing tub 30 when a predetermined time elapses after the washing process is initiated to identify whether to terminate the washing process or perform the washing process additionally.

This will be described in detail with reference to FIGS. 7 and 8.

Figure 7:
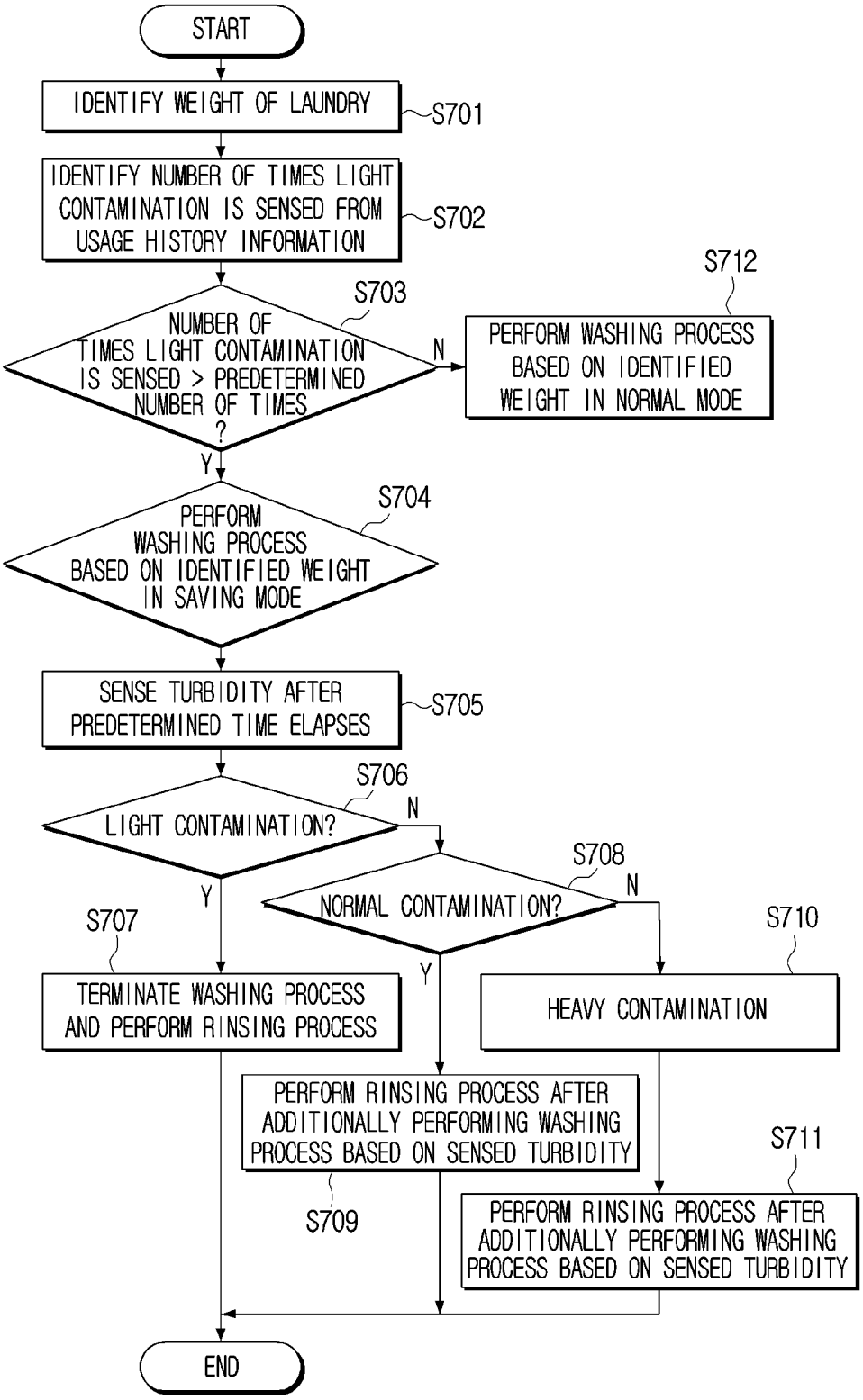
FIG. 7 is a flowchart illustrating a washing machine that identifies an operation mode based on the contamination level identification history according to one or more embodiments of the disclosure.

FIG. 7 is a flowchart illustrating a washing machine that identifies an operation mode based on the contamination level identification history according to one or more embodiments of the disclosure.

Referring to FIG. 4, the one or more processors 140 according to an example may identify a weight of laundry contained in the washing tub 30 when a user instruction for operating the washing machine 100 is received (S701).

Subsequently, based on the number of times minor contamination is identified being equal to or greater than a predetermined number based on the contamination level identification history (S702 and S703: Y), the one or more processors 140 may perform a washing process based on the identified weight in the saving mode. (S704).

Subsequently, the one or more processors 140 may identify the level of contamination inside the washing tub 30 based on a turbidity of water sensed by the turbidity sensor 130 when a predetermined time elapses after the washing process is initiated (S705).

Subsequently, based on the identified level of contamination corresponding to minor contamination (S706: Y), the one or more processors 140 may terminate the washing process and initiate a rinsing process (S707).

Meanwhile, based on the identified level of contamination not corresponding to minor contamination and corresponding to normal contamination (S706: N and S708: Y), the one or more processors 140 may initiate a rinsing process after additionally performing the washing process based on the sensed turbidity (S709).

For example, based on the identified level of contamination corresponding to normal contamination (S708: Y), the one or more processors 140 may additionally supply detergent to the washing tub 30, increase the time for which the washing process needs to be conducted, and increase the temperature of the water supplied to the washing tub 30 to additionally perform the washing process. For example, the one or more processors 140 may increase the temperature of the water inside the washing tub 30 by using a heater provided under the washing tub 30.

For example, after the detergent is additionally supplied by about 15% and the temperature of the water inside the washing tub 30 is increased, the one or more processors 140 may perform the washing process for an increased time for which the washing process needs to be conducted (S709).

Meanwhile, based on the identified level of contamination not corresponding to normal contamination and corresponds to heavy contamination (S708: N and S710), the one or more processors 140 may initiate a rinsing process after additionally performing the washing process based on the sensed turbidity (S711).

For example, based on the identified level of contamination corresponding to heavy contamination (S710), the one or more processors 140 may additionally supply the detergent to the washing tub 30 by about 25%, and increase the time for which the washing process needs to be conducted and the temperature of the water to be supplied into the washing tub 30, as compared to those in step S709, to additionally perform the washing process.

Here, the specific numerical value is an example for convenience of description, and the numerical value is not limited thereto. For example, the one or more processors 140 may increase the amount of detergent to be additionally supplied to the washing tub 30, the time for which the washing process needs to be additionally conducted, and the temperature of the water in the washing tub 30 in proportion to the turbidity sensed by the turbidity sensor 130.

In addition, based on the identified level of contamination exceeding a threshold level of contamination, the one or more processors 140 may increase the number of rinsings during a rinsing process in the saving mode.

For example, based on the identified level of contamination corresponding to normal contamination, the one or more processors 140 may increase the number of rinsings (the number of times of rinsing in a rinsing process in the saving mode) from two times to three times.

As another example, based on the identified level of contamination corresponding to heavy contamination, the one or more processors 140 may increase the number of rinsings (the number of times of rinsing in a rinsing process in the saving mode) from two times to four times. Here, the specific numerical value is an example for convenience of description, and the numerical value is not limited thereto.

On the other hand, based on the number of times minor contamination is identified is smaller than the predetermined number based on the contamination level identification history (S702 and S703: N), the one or more processors 140 according to an example may perform a washing process based on the identified weight in the normal mode (S712).

Subsequently, when a predetermined time elapses after the washing process is initiated in the normal mode, the one or more processors 140 may identify a level of contamination inside the washing tub 30.

Subsequently, based on the identified level of contamination corresponding to minor contamination, the one or more processors 140 may terminate the washing process and initiate a rinsing process. As another example, based on the identified level of contamination not corresponding to minor contamination, the one or more processors 140 may perform the washing process for a residual time. Here, the residual time may refer to a remaining time obtained by excluding the predetermined time from the time for which the washing process needs to be conducted in the normal mode.

Figure 8:
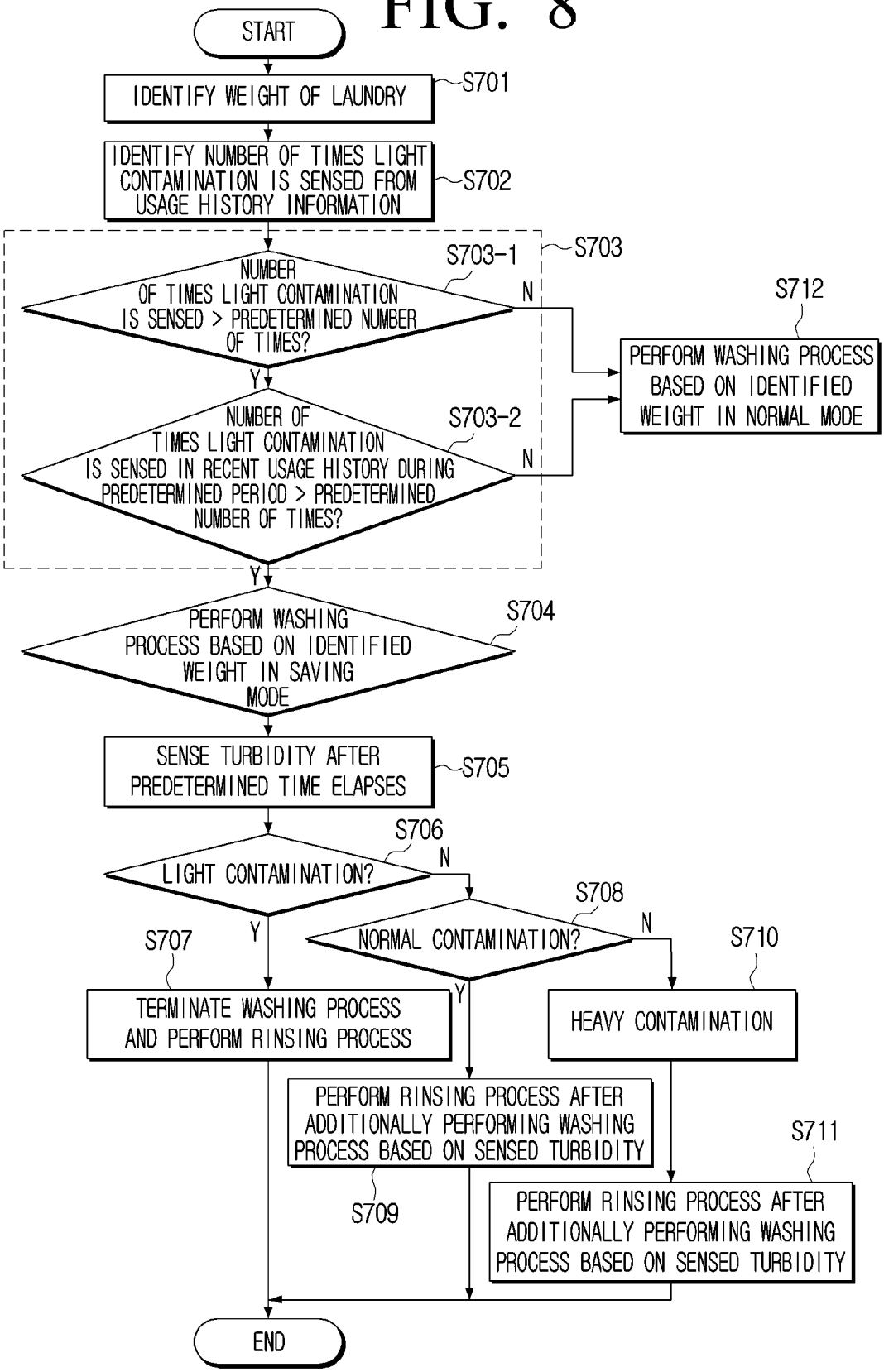
FIG. 8 is a flowchart for explaining the washing machine that identifies an operation mode based on levels of contamination identified within a predetermined period according to one or more embodiments of the disclosure.

FIG. 8 is a flowchart for explaining the washing machine that identifies an operation mode based on levels of contamination identified within a predetermined period according to one or more embodiments of the disclosure.

Concerning FIG. 8, redundant descriptions of the steps described with reference to FIG. 7 will be omitted.

Referring to FIG. 8, step S703, in which the one or more processors 140 identify whether the number of times minor contamination is identified is equal to or greater than a predetermined number based on the contamination level identification history, may include step S703-1 and step S703-2.

First, the one or more processors 140 may identify whether the number of times minor contamination is identified is equal to or greater than the predetermined number of times, based on the contamination level identification history stored in the memory 150 (S702). Subsequently, based on the number of times minor contamination is identified being equal to or greater than the predetermined number (S703-1: Y), the one or more processors 140 may identify whether at least one level of contamination identified within a predetermined period among the plurality of levels of contamination included in the contamination level identification history corresponds to minor contamination (S703-2).

Here, the predetermined period may refer to a period (hereinafter, a recent period) from a current time point to a time point past as much as a predetermined period (e.g., one month).

For example, based on levels of contamination of laundry washed by the washing machine 100 generally corresponding to minor contamination, the one or more processors 140 may additionally identify that the levels of contamination of the laundry washed by the washing machine 100 have generally corresponded to minor contamination during the recent period in step S703-2.

As an example, based on levels of contamination of laundry washed by the washing machine 100 during the recent period generally corresponding to normal contamination (or heavy contamination), rather than minor contamination, the one or more processors 140 may operate the washing machine 100 in the normal mode, not in the saving mode.

As another example, based on levels of contamination of laundry washed by the washing machine 100 during the recent period generally corresponding to minor contamination, the one or more processors 140 may operate the washing machine 100 in the saving mode.

For example, based on a ratio of levels of contamination corresponding to minor contamination with respect to at least one level of contamination identified within the predetermined period among the plurality of levels of contamination included in the contamination level identification history being equal to or greater than a threshold ratio (e.g. 70%), the one or more processors 140 may operate the washing machine 100 in the saving mode.

Meanwhile, the predetermined period may include n levels of contamination identified recently in chronological order, as well as a period (hereinafter, a recent period) from a current time point to a time point past as much as a predetermined period (e.g., one month).

For example, based on at least two of the three levels of contamination identified recently from the current time point corresponding to minor contamination, the one or more processors 140 may operate the washing machine 100 in the saving mode. Meanwhile, the specific numerical value is an example for convenience of description, and the numerical value is not limited thereto. For example, based on one or more of the two levels of contamination identified recently from the current time point corresponding to minor contamination, the one or more processors 140 may operate the washing machine 100 in the saving mode.

According to an example, in the saving mode, as compared to the normal mode, it is possible to reduce consumption of detergent and consumption of power, such as a reduction in the amount of detergent supplied to the washing tub 30 by 10%, a reduction in the time for which the washing process needs to be conducted by 5 minutes or more, or a reduction in the temperature of the water inside the washing tub 30 by 5° C. or more.

According to an example, based on a predetermined condition being satisfied (e.g., based on the number of times minor contamination is identified being equal to or greater than a predetermined number based on the contamination level identification history), the one or more processors 140 first operate the washing machine 100 in the saving mode, and if necessary (for example, based on the level of contamination inside the washing tub 30 not corresponding to minor contamination when a predetermined time elapses after the washing process is initiated), additionally perform the washing process (by additionally supplying the detergent, increasing the time for which the washing process needs to be conducted, or increasing the temperature of the water, etc.). As a result, it is possible to appropriately remove contaminants in the laundry, while reducing energy consumption.

Returning to FIG. 3, the memory 150 according to an example of the disclosure may be implemented as an internal memory included in the processor 140, such as a ROM (e.g., an electrically erasable programmable read-only memory (EEPROM)) or a RAM, or may be implemented as a memory separate from the processor 140. In this case, depending on the data storage purpose, the memory 150 may be implemented in the form of a memory embedded in the washing machine 100 or in the form of a memory removable from the washing machine 100. For example, data for driving the washing machine 100 may be stored in the memory embedded in the washing machine 100, and data for extended functions of the washing machine 100 may be stored in the memory removable from the washing machine 100.

Meanwhile, the memory embedded in the washing machine 100 may be implemented as at least one of a volatile memory (e.g. a dynamic RAM (DRAM), a static RAM (SRAM), or a synchronous dynamic RAM (SDRAM)) and a non-volatile memory (e.g., a one time programmable ROM (OTPROM), a programmable ROM (PROM), an erasable and programmable ROM (EPROM), an electrically erasable and programmable ROM (EEPROM), a mask ROM, a flash ROM, a flash memory (e.g. a NAND flash or a NOR flash), a hard drive, or a solid state drive (SSD)), and the memory removable from the washing machine 100 may be implemented in the form of a memory card (e.g., a compact flash (CF), a secure digital (SD), a micro secure digital (Micro-SD), a mini secure digital (Mini-SD), an extreme digital (xD), or a multi-media card (MMC)), an external memory connectable to a USB port (e.g., a USB memory), or the like.

In a controlling method of a washing machine according to an example of the disclosure, first, a weight of laundry contained in the washing tub is identified when a user instruction for operating the washing machine is received.

Subsequently, a saving mode is identified as an operation mode based on the number of times minor contamination is identified being equal to or greater than a predetermined number based on a contamination level identification history, and a normal mode is identified as an operation mode based on the number of times minor contamination is identified being smaller than the predetermined number.

Subsequently, a washing process is initiated based on the weight in the identified operation mode.

Subsequently, a level of contamination inside the washing tub is identified based on a turbidity of water sensed by a turbidity sensor when a predetermined time elapses after the washing process is initiated.

Subsequently, whether to terminate the washing process is identified based on the identified level of contamination.

Here, the identifying of the operation mode may include: identifying whether at least one level of contamination identified within a predetermined period among a plurality of levels of contamination included in the contamination level identification history corresponds to the minor contamination, based on the number of times minor contamination is identified being equal to or greater than the predetermined number; and identifying the saving mode as the operation mode, based on the identified at least one level of contamination corresponding to the minor contamination, and identifying the normal mode as the operation mode, based on the identified at least one level of contamination not corresponding to the minor contamination.

According to an example, in the initiating of the washing process, at least one of an amount of detergent to be supplied into the washing tub, a time for which the washing process needs to be conducted, a temperature of the water to be supplied into the washing tub, or a rotation speed of a driving unit may be reduced, as compared to that in the normal mode, based on the operation mode being identified to be the saving mode.

According to an example, the identifying of the level of contamination may include identifying a level of contamination inside the washing tub when the predetermined time elapses after the washing process is initiated in the saving mode, and the identifying of whether to terminate the washing process may include: terminating the washing process and initiating a rinsing process, based on the identified level of contamination corresponding to the minor contamination; and initiating an extra washing process based on the identified level of contamination, based on the identified level of contamination not corresponding to the minor contamination.

Here, the initiating of the extra washing process may include performing the washing process for an extra time after additionally supplying detergent to the washing tub according to the extra washing process and increasing a temperature of the water supplied to the washing tub, and each of an amount of the additional supply of the detergent, an amount of the increase in the temperature of the water, and the extra time according to the extra washing process may be proportional to the identified level of contamination.

According to an example of the disclosure, the initiating of the extra washing process may include initiating the rinsing process after performing the extra washing process based on the identified level of contamination, based on the identified level of contamination not corresponding to the minor contamination; and increasing the number of rinsings during the rinsing process in the saving mode, based on the identified level of contamination exceeding a threshold level of contamination.

The controlling method according to an example of the disclosure may further include updating the contamination level identification history based on the identified level of contamination.

According to an example of the disclosure, the identifying of the level of contamination may include identifying a level of contamination inside the washing tub when the predetermined time elapses after the washing process is initiated in the normal mode, the identifying of whether to terminate the washing process may include: terminating the washing process and initiating a rinsing process, based on the identified level of contamination corresponding to the minor contamination; and performing the washing process for a residual time, based on the identified level of contamination not corresponding to the minor contamination, and the residual time may be a remaining time obtained by excluding the predetermined time from the time for which the washing process needs to be conducted in the normal mode.

Meanwhile, the methods according to various embodiments of the disclosure described above may be implemented in the form of an application that is installable in an existing washing machine.

In addition, the methods according to various embodiments of the disclosure described above may be implemented by simply upgrading software or hardware with respect to an existing washing machine.

In addition, the various embodiments of the disclosure described above may be performed through an embedded server included in the washing machine or an external server of at least one of the washing machine and the display device.

Meanwhile, according to one or more embodiments of the disclosure, the various embodiments described above may be implemented as software including instructions stored in machine-readable storage medium (e.g., computer-readable storage media). The machine is a device capable of calling a stored instruction from the storage media and operating according to the called instruction, and may include a washing machine according to the embodiments disclosed herein. When an instruction is executed by a processor, a function corresponding to the instruction may be performed by the processor directly or using other components under the control of the processor. The instruction may include a code generated or executed by a compiler or interpreter. The machine-readable storage media may be provided in the form of non-transitory storage media. Here, the term "non-transitory" only means that the storage media is tangible without including a signal, irrespective of whether data is semi-permanently or transitorily stored in the storage media.

In addition, according to one or more embodiments of the disclosure, the method according to various embodiments described above may be included in a computer program product for provision. The computer program product may be traded as a product between a seller and a buyer. The computer program product may be distributed in the form of a machine-readable storage medium (e.g., a compact disc read only memory (CD-ROM)), or may be distributed online via an application store (e.g., Play Store™). If the computer program product is distributed online, at least part of the computer program product may be temporarily generated or at least temporarily stored in a storage medium, such as a memory of a server of a manufacturer, a server of an application store, or a relay server.

In addition, each of the components (e.g., modules or programs) according to various embodiments described above may include a single entity or multiple entities, and some of the above-described sub-components may be omitted, or other sub-components may be further included in the various embodiments. Alternatively or additionally, some components (e.g., modules or programs) may be integrated into a single entity, and the integrated entity may perform the same or similar functions performed by the respective components before being integrated. According to various embodiments, operations performed by the modules, the programs, or other components may be executed sequentially, in parallel, repeatedly, or heuristically, or at least some of the operations may be executed in different sequences or omitted, or other operations may be added.

Although the preferred embodiments of the disclosure have been illustrated and described above, the disclosure is not limited to the specific embodiments described above, and various modification may be made by those skilled in the art without departing from the gist of the disclosure as claimed in the appended claims. Such modifications should not be individually understood from the technical spirit or prospect of the disclosure.

Although the present disclosure has been described with various embodiments, various changes and modifications may be suggested to one skilled in the art. It is intended that the present disclosure encompass such changes and modifications as fall within the scope of the appended claims.

What is claimed is:

1. A washing machine including a washing tub, the washing machine comprising:

a driving unit configured to rotate the washing tub;

a turbidity sensor configured to sense a turbidity of water inside the washing tub; and one or more processors configured to:

identify a weight of laundry contained in the washing tub when a user instruction for operating the washing machine is received;

identify a saving mode as an operation mode, based on a number of minor contaminations identified being equal to or greater than a predetermined number based on a contamination level identification history;

identify a normal mode as the operation mode based on the number of minor contaminations identified being smaller than the predetermined number;

initiate a washing process based on the weight of the laundry in the identified operation mode;

identify a level of contamination inside the washing tub based on the turbidity of water sensed by the turbidity sensor when a predetermined time elapses after the washing process is initiated;

identify whether to terminate the washing process based on the identified level of contamination; and update the contamination level identification history based on the identified level of contamination, wherein the one or more processors are further configured to:

identify whether at least one level of contamination identified within a predetermined period among a plurality of levels of contamination included in the contamination level identification history corresponds to minor contamination based on the number of minor contaminations identified being equal to or greater than the predetermined number;

identify the saving mode as the operation mode based on the at least one level of contamination corresponding to the minor contamination; and identify the normal mode as the operation mode based on the at least one level of contamination not corresponding to the minor contamination.

2. The washing machine as claimed in claim 1, wherein the one or more processors are configured to reduce, based on the operation mode being identified to be the saving mode, at least one of an amount of detergent to be supplied into the washing tub, a time for conducting the washing process, a temperature of the water to supply into the washing tub, or a rotation speed of the driving unit, as compared to that in the normal mode.

3. The washing machine as claimed in claim 1, wherein the one or more processors is configured to:

identify the level of contamination inside the washing tub when the predetermined time elapses after the washing process is initiated in the saving mode;

terminate the washing process and initiate a rinsing process, based on the identified level of contamination corresponding to minor contamination; and initiate an extra washing process based on the identified level of contamination not corresponding to the minor contamination.

4. The washing machine as claimed in claim 3, wherein:

the one or more processors is configured to perform the washing process for an extra time after an additional supply of detergent is added to the washing tub according to the extra washing process and increasing a temperature of the water supplied to the washing tub, and each of an amount of the additional supply of the detergent, an amount of the increase in the temperature of the water, and the extra time according to the extra washing process is proportional to the identified level of contamination.

5. The washing machine as claimed in claim 3, wherein the one or more processors is configured to:

initiate the rinsing process after performing the extra washing process based on the identified level of contamination not corresponding to the minor contamination; and increase a number of rinsings during the rinsing process in the saving mode based on the identified level of contamination exceeding a threshold level of contamination.

6. The washing machine as claimed in claim 1, wherein:

the one or more processors is configured to:

identify the level of contamination inside the washing tub when the predetermined time elapses after the washing process is initiated in the normal mode;

terminate the washing process and initiating a rinsing process based on the identified level of contamination corresponding to minor contamination; and perform the washing process for a residual time based on the identified level of contamination not corresponding to the minor contamination, and the residual time is a remaining time obtained by excluding the predetermined time from a time for which the washing process needs to be conducted in the normal mode.

7. A controlling method of a washing machine, the controlling method comprising:

identifying a weight of laundry contained in a washing tub when a user instruction for operating the washing machine is received;

identifying a saving mode as an operation mode based on a number of minor contaminations identified being equal to or greater than a predetermined number based on a contamination level identification history;

identifying a normal mode as the operation mode based on the number of minor contaminations identified being smaller than the predetermined number;

initiating a washing process based on the weight of the laundry in the identified operation mode;

identifying a level of contamination inside the washing tub based on a turbidity of water sensed by a turbidity sensor when a predetermined time elapses after the washing process is initiated;

identifying whether to terminate the washing process based on the identified level of contamination; and updating the contamination level identification history based on the identified level of contamination, wherein the identifying of the operation mode includes:

identifying whether at least one level of contamination identified within a predetermined period among a plurality of levels of contamination included in the contamination level identification history corresponds to minor contamination, based on the number of minor contaminations identified being equal to or greater than the predetermined number;

identifying the saving mode as the operation mode based on the at least one level of contamination corresponding to the minor contamination; and identifying the normal mode as the operation mode based on the at least one level of contamination not corresponding to the minor contamination.

8. The controlling method as claimed in claim 7, wherein initiating the washing process comprises reducing based on the operation mode being identified to be the saving mode, at least one of an amount of detergent to be supplied into the washing tub, a time for conducting the washing process, a temperature of the water to be supplied into the washing tub, or a rotation speed of a driving unit, as compared to that in the normal mode.

9. The controlling method as claimed in claim 7, wherein:

the identifying of the level of contamination comprises identifying the level of contamination inside the washing tub when the predetermined time elapses after the washing process is initiated in the saving mode, and the identifying of whether to terminate the washing process includes:

terminating the washing process and initiating a rinsing process, based on the identified level of contamination corresponding to minor contamination; and initiating an extra washing process based on the identified level of contamination not corresponding to the minor contamination.

10. The controlling method as claimed in claim 9, wherein the initiating of the extra washing process includes performing the washing process for an extra time after an additional supply of detergent is added to the washing tub according to the extra washing process and increasing a temperature of the water supplied to the washing tub, and each of an amount of the additional supply of the detergent, an amount of the increase in the temperature of the water, and the extra time according to the extra washing process is proportional to the identified level of contamination.

11. The controlling method as claimed in claim 9, wherein the initiating of the extra washing process includes:

initiating the rinsing process after performing the extra washing process based on the identified level of contamination not corresponding to the minor contamination; and increasing a number of rinsings during the rinsing process in the saving mode based on the identified level of contamination exceeding a threshold level of contamination.

* * * * *